US009728849B2

(12) United States Patent
Kolokotronis

(10) Patent No.: US 9,728,849 B2
(45) Date of Patent: Aug. 8, 2017

(54) ANTENNA ALIGNMENT APPARATUS AND METHOD

(75) Inventor: Dimitris Kolokotronis, Athens (GR)

(73) Assignee: FASMETRICS S.A., Athens (GR)

( * ) Notice: Subject to any disclaimer, the term of this patent is extended or adjusted under 35 U.S.C. 154(b) by 239 days.

(21) Appl. No.: 14/232,700

(22) PCT Filed: Jul. 16, 2012

(86) PCT No.: PCT/EP2012/063938
§ 371 (c)(1),
(2), (4) Date: Apr. 7, 2014

(87) PCT Pub. No.: WO2013/011002
PCT Pub. Date: Jan. 24, 2013

(65) Prior Publication Data

US 2014/0218249 A1 Aug. 7, 2014

(30) Foreign Application Priority Data

Jul. 15, 2011 (GB) ..... 1112149.8

(51) Int. Cl.
*H01Q 3/00* (2006.01)
*H01Q 3/08* (2006.01)
(Continued)

(52) U.S. Cl.
CPC ..... *H01Q 3/08* (2013.01); *H01Q 1/125* (2013.01); *H01Q 1/246* (2013.01)

(58) Field of Classification Search
USPC ..... 343/765, 757, 768, 702, 793, 767; 342/359
See application file for complete search history.

(56) References Cited

U.S. PATENT DOCUMENTS 5,223,845 A * 6/1993 Eguchi ..... H01Q 3/08 342/359
2005/0248496 A1 11/2005 Chen et al.
(Continued)

FOREIGN PATENT DOCUMENTS

CN 201349052 11/2009
EP 1753075 2/2007
(Continued)

OTHER PUBLICATIONS

International Written Opinion in PCT/EP2012/063938 dated Apr. 18, 2013.
(Continued)

*Primary Examiner* — Hoang Nguyen
*Assistant Examiner* — Hai Tran
(74) *Attorney, Agent, or Firm* — Barnes & Thornburg LLP

(57) ABSTRACT

A method of adjusting at least one cellular communications antenna mounted on an antenna structure, wherein the antenna, and/or direction of the radiation pattern of the antenna, is movable relative to the antenna structure, the method comprising the steps: determining or retrieving current position values of the antenna, and/or direction of the radiation pattern of the antenna, in first, second and third dimensions; receiving a desired position value for the antenna, and/or direction of the radiation pattern of the antenna, in the first dimension relating to a desired position of the antenna; determining a new position value for the antenna, and/or direction of the radiation pattern, of the antenna in the second dimension based on required movement of the antenna, and/or direction of the radiation pattern of the antenna, relative to the antenna structure to reach the desired position value in the first dimension; determining a new position value for the antenna, and/or direction of the
(Continued)

radiation pattern of the antenna, in the third dimension based on required movement of the antenna relative to the antenna structure to reach the desired position value in the first dimension; calculating the difference between the current and new position values in the second dimension; calculating the difference between the current and new position values in the third dimension; adjusting the position of the antenna, and/or direction of the radiation pattern of the antenna, towards the desired position by moving the antenna, and/or direction of the radiation pattern of the antenna, relative to the antenna structure based at least in part on the calculated difference of first and second positions in at least the second dimension.

10 Claims, 12 Drawing Sheets

(51) Int. Cl.
*H01Q 1/24* (2006.01)
*H01Q 1/12* (2006.01)

(56) References Cited

U.S. PATENT DOCUMENTS

| | | | |
|---|---|---|---|
| 2006/0087476 | A1 | 4/2006 | Piburn et al. |
| 2009/0195467 | A1 | 8/2009 | Vassilakis |

FOREIGN PATENT DOCUMENTS

| | | |
|---|---|---|
| GB | 2474605 | 4/2011 |
| JP | 2000278021 | 10/2000 |
| WO | WO 0201669 | 1/2002 |
| WO | WO 2007093689 | 8/2007 |
| WO | 2011042226 | 4/2011 |

OTHER PUBLICATIONS

International Search Report in PCT/EP2012/063938 dated Apr. 18, 2013.

United Kingdom Search Report in GB1112149.8 dated Nov. 4, 2011.

* cited by examiner

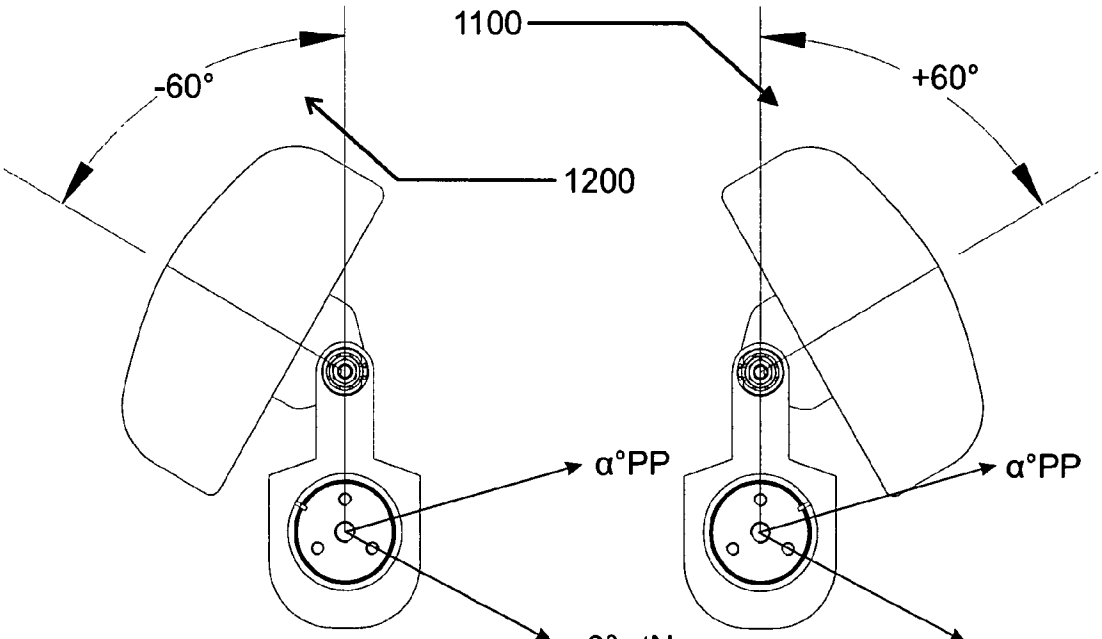
FIG. 4c
FIG. 4b
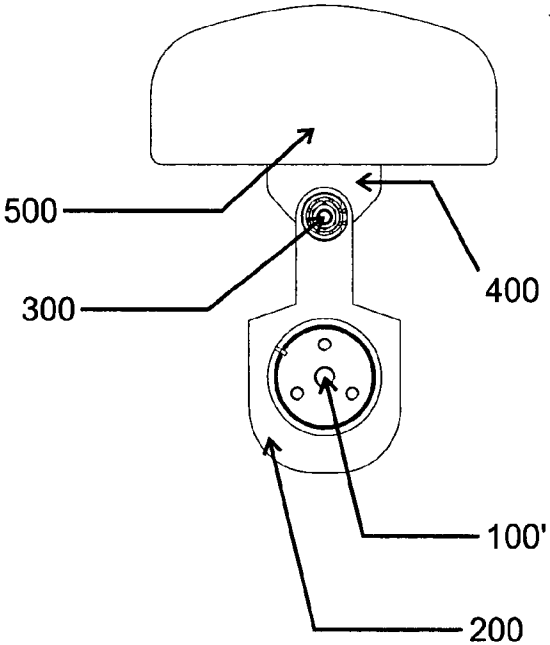
FIG. 4a

ANTENNA ALIGNMENT APPARATUS AND METHOD

TECHNICAL FIELD

The present invention relates to a method for and apparatus for enabling repeatable accurate alignment of a communication antenna that is attached to antenna brackets without the need for a technician, rigger or climber to come in direct contact with the antenna itself.

BACKGROUND TO THE INVENTION

Antenna structures are used by cellular communications network/service providers to receive antennas for transmission and reception of radio signals. A typical antenna structure comprises a tower, one or more antenna brackets attached on the tower top, so that one or more antennas are attached on the antenna brackets. Usually, the tower is firstly assembled at the point of installation and then the antenna brackets are mounted on the tower itself. Antennas are attached to the antenna brackets by means of mounting bolts and screws or other securing means, defining a specific horizontal (azimuth) and vertical (tilt) directionality for the transmission and reception of radio signals.

To achieve high network performance, provide high quality radio link transmissions and receptions and ensure high spectrum efficiency, the panel antennas must be aligned with minimum inaccuracy (less than ±1°) to the specified horizontal (azimuth) and vertical (tilt) directionality angles provided by the radio planning process and antenna installation work orders. Accurate alignment of panel antennas is of paramount importance in a competitive wireless communication industry as even small errors in azimuth and tilt alignment (more than ±5° for azimuth and more than ±1° for tilt) can seriously degrade radio network quality. See, for example, the reference paper "Impact of Mechanical Antenna Downtilt on Performance of WCDMA Cellular Network" and also the paper "Impacts of Antenna Azimuth and Tilt Installation Accuracy on UMTS Network Performance" by Bechtel Corp.

Several prior art solutions are currently available for accurate alignment of antennas azimuth and tilt. For example, US20090021447 and US20110225804 describe a device for measuring the orientation of an antenna in three directions, i.e. azimuth, tilt and roll. The device is directly secured to an antenna and displays the measured values for azimuth, tilt and roll, allowing a user to accurately align an antenna to the desired directions. A deficiency of the prior art is that such a device cannot be employed in antenna structures having one or more antennas covered under a radome, due to the fact that antenna accessibility from an antenna technician, rigger or climber is not possible or generally limited (examples of such antenna structures are disclosed in US20050134512A1 & WO2011042226). As a result, the use of the measurement devices described in US20090021447 and US20110225804 are not applicable to serve the purpose of accurate alignment of antenna structures covered under a radome.

Furthermore, due to modern networks' dynamic nature, continuous antenna azimuth and tilt re-adjustment during the lifecycle of a base station site (for one or more antennas) is required; therefore, the antenna brackets, the antennas or the antenna structure itself should be capable to provide the suitable means for facilitating such needs. Each antenna is designed to serve a specific area, namely a cell or sector. Cell direction, i.e. antenna azimuth & tilt, is produced by modeling multiple aspects of radio access technology as well as accounting for radio propagation science by using radio planning tools. The main aim of the radio network planning process is to provide optimum performance for the radio network in terms of coverage, capacity and quality. The network planning process and base station site design criteria vary from cluster to cluster depending upon the dominating factor, which is optimum performance. Said coverage may include defining the coverage areas, service probability and related signal strength; said capacity may include subscriber density and traffic profiles in the coverage region and whole area, availability of the frequency bands, frequency planning methods, and other information such as guard band and frequency band division; said quality is related to radio interference metrics such as signal to noise ratio. Since all radio network performance aspects are fully dynamic, the radio network planning process that selects antenna directionality at installation phase cannot ensure that the selection criteria (i.e. capacity, coverage and quality) will remain the same after a period of time. Usually, the antennas are installed and operated for at least 7 to 10 years or even more. This fact by itself, means that the antenna azimuth and tilt directions must often change during the base station site lifecycle by re-adjustment means. Ideally, antenna azimuth and tilt re-adjustment should be considered at least once every six months for every antenna in the network, especially in urban and heavy urban areas where the demands on capacity and quality of radio base station clusters are continuously shifting.

When antenna system azimuth and tilt re-adjustment is to be performed, such re-adjustment should take place without the need to climb on the tower top, so as to avoid complicated operations of high opex (operational expediture) costs (due to climbing) and also ensuring health and safety at work for antenna technicians, riggers and climbers. It is well known that human exposure on high electromagnetic fields is an issue to be considered by the network service providers for those working in close proximity to radiating antenna systems. Climbing on the tower top in order to set or re-adjust the directionality of antennas is not avoided by use of the devices disclosed in US20090021447 and US20110225804 as they do not provide the means for such operations. However, when such devices are not used, the problem of antennas azimuth and tilt accurate alignment for any directionality re-adjustment by remote operation remains.

In the case where there is a need to satisfy both antenna alignment accuracy and remote re-adjustability (with no climbing) with accuracy, an electromechanical apparatus that performs both actions needs to be deployed. A single pivot axis antenna bracket that offers remote azimuth adjustment by electromechanical means is disclosed in WO2007093689A1. However, a deficiency of such prior art is that such an antenna bracket cannot satisfy the alignment accuracy required by the radio planning process and antenna system installation work orders without use of devices disclosed in US20090021447 and US20110225804. This is due to the fact that the proposed electromechanical system attached on the antenna bracket does not provide absolute azimuth, tilt and roll measurement means. The result of this is that all of the disadvantages introduced by use of US20090021447 and US20110225804 (as described in the previous paragraphs) follow as disadvantages also for apparatus of WO2007093689A1. Furthermore, a single pivot axis antenna system that offers remote azimuth adjustment by electromechanical actuation but also attempts to provide absolute azimuth, tilt and roll measurement means is also disclosed on US20090195467. However, a deficiency of such prior art is that such a solution utilizes an earth gravitational magnetic field sensor which, by default, introduces inaccuracy due to magnetic field disturbances caused from the antenna systems, the antenna brackets and the antenna structure itself (i.e. soft and hard iron effects). Therefore, such a solution, although it offers both antenna system alignment accuracy and remote re-adjustability with accuracy, does not address the issue of high overall accuracy.

The deficiencies exemplary of the apparatus of WO2007093689A1 and US20090195467 are applicable not only in these documents, but also when antenna systems are attached on antenna brackets that utilize more than one pivot axis for horizontal (azimuth) alignment and movement. In a particular example of antenna system directionality, two antennas may need to have the same horizontal direction or the same azimuth angle. In order to align and direct both antenna systems to the same azimuth angle, prior art US20060087476 proposes a dual pivot axis antenna bracket for installation on a triangular tower utilizing antenna sector frames. WO2011042226 (GB2474605) proposes a dual pivot axis antenna bracket for installation on a monopole structure by utilizing a collar. This prior art provides the capability, due to the dual pivot axis antenna bracket attached on the antenna structure, to offer full motion freedom on the antenna system(s) (needed for future horizontal azimuth re-adjustments) by maximizing the allowable antenna system horizontal (azimuth) movement range.

It is the purpose of the present invention to overcome or at least mitigate at least some of the aforementioned disadvantages of the prior art. In particular, it is the purpose of the present invention to propose a method for and apparatus for enabling the accurate, and repeatably accurate, alignment of communication antenna systems that are attached on either single or dual pivot axis antenna brackets, without the need for a technician, rigger or climber to come in direct contact with the antenna system itself.

SUMMARY OF THE INVENTION

Aspects and preferable features of the invention are defined by the appended claims.

BRIEF DESCRIPTION OF THE DRAWINGS

An example of an antenna alignment apparatus and method according to the present invention will be described with reference to the accompanying figures in which:

FIG. 4*a* is a plan view of a single antenna sector in a 'home position';

FIG. 4*b* is a plan view of a single antenna sector after anticlockwise rotation from the position shown in FIG. 4*a;*

FIG. 4*c* is a plan view of a single antenna sector after clockwise rotation from the position shown in FIG. 4*a;*

DETAILED DESCRIPTION

Figure 1B:
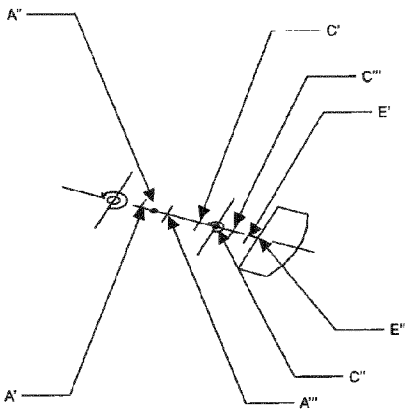
FIG. 1*b* is a schematic plan view representation of a single sector antenna structure according to an embodiment.
Figure 1A:
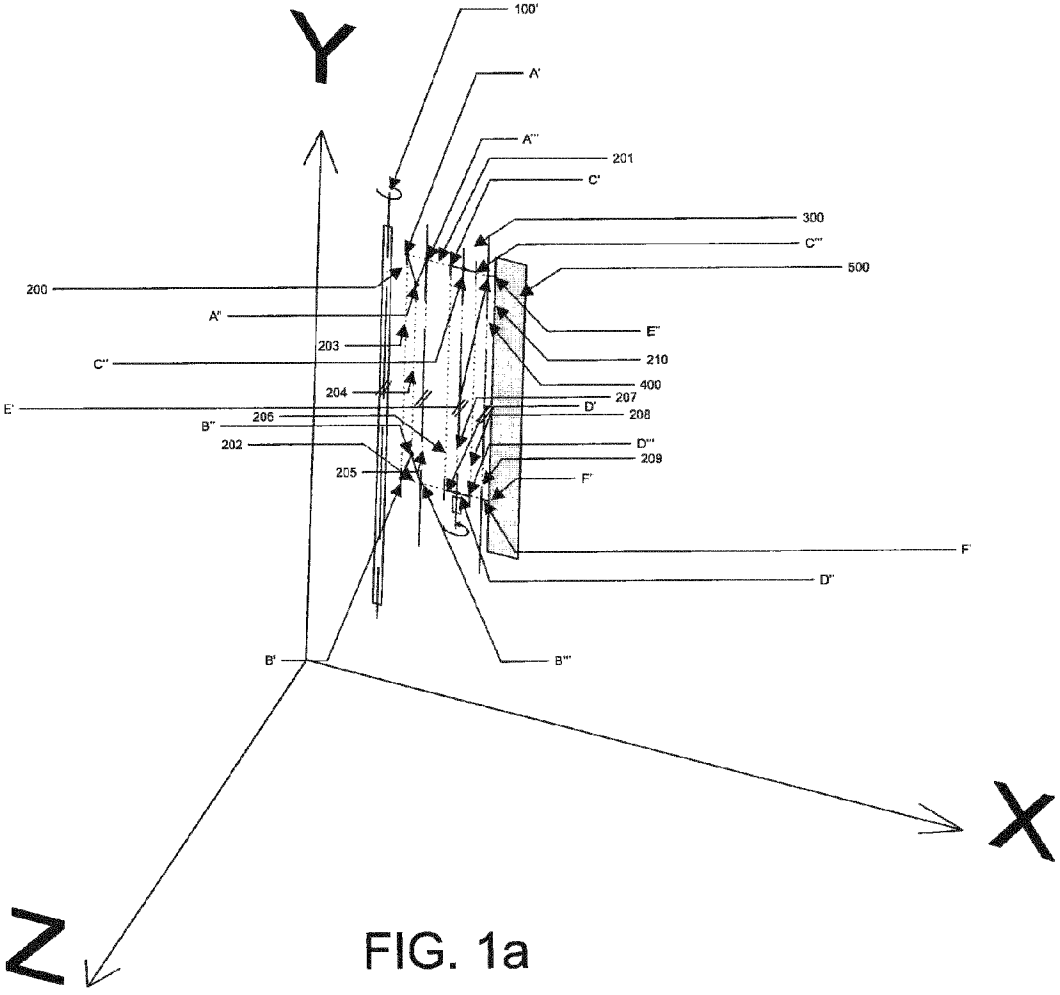
FIG. 1*a* is a schematic side view representation of a single sector antenna structure according to an embodiment.

FIGS. 1*a* and 1*b* are schematic diagrams of an antenna 500 mounted on an antenna structure 100'. The joints described below in relation to FIGS. 1*a* and 1*b* can, one some embodiments, allow for mechanical adjustment of the position of antenna 500 relative to the antenna structure 100 in three dimensions (i.e. mechanical movement of antenna 500 so as to adjust the radiation pattern direction of the in azimuth, tilt and roll planes). However, in some embodiments, adjustment of tilt and roll is achieved electrically, rather than mechanically, by controlling the dipole feeding lines.

The antenna structure comprises central portion 100 which is attached to a first antenna bracket mounting formation 200. The first antenna bracket mounting formation 200 is attached to single pivot axis mounting formation 300. The single pivot axis mounting formation 300 is attached to a second antenna bracket mounting formation 400, and the second antenna bracket mounting formation 400 is attached to a panel antenna system 500. The first antenna bracket mounting formation 200 is mounted to the central portion 100 by central top and bottom joints A' and B' respectively and is mounted to the single pivot axis mounting formation 300 by central top and bottom joints A''' and B''' respectively. The first antenna bracket mounting formation 200 also comprises the joints A'' and B'' that serve the purpose of defining or setting the vertical (tilt) heading of the antenna system with respect to the antenna structure central vertical axis 100'.

The single pivot axis mounting formation 300 is mounted to the first antenna bracket mounting formation 200 by central top and bottom joints C' and D' respectively. The single pivot axis mounting formation 300 is mounted to the second antenna bracket mounting formation 400 by central top and bottom joints C''' and D''' respectively. The single pivot axis mounting formation 300 also comprises central joints C'' and D'' that define the horizontal (azimuth) directionality of the antenna system (with respect to the perpendicular lines as shown in FIG. 1*a*) by the respective central top mounting joints A', A''', C', C'' and the central bottom mounting joints B', B''', D', D'' with respect to the antenna structure central vertical axis 100'.

The second antenna bracket mounting formation 400 is mounted to the antenna system by central top and bottom joints E'' and F'' respectively. The second antenna bracket mounting formation 400 is mounted to the single pivot axis mounting formation 300 by central top and bottom joints E' and F' respectively. In order to position the horizontal (azimuth), vertical (tilt) and adjacent vertical (roll) heading of antenna system 500 a known, pre-calibrated, 3-dimensional position (herein referred to as "home position") with respect to the antenna structure central vertical axis 100', the top mounting central joints A', A'", C', C", C'", E' and E" are placed in line, thus forming a central line A'-E" 201. This central line 201 is perpendicular to the central vertical axis 100'. The same applies for the bottom mounting central joints B', B'", D', D", D'", F' and F" which form the central line B'-F" 202, where this central line 202 is parallel to the central line 201 and perpendicular to the central vertical axis 100'.

Additionally, the top mounting central joints A', A", A', C', C", C", E' and E" and the respective bottom mounting central joints B', B", B'", D', D", D'", F' and F" are in pairs forming the respective central lines A'-B' 203, A"-B" 204, A'"-B'" 205, C'-D' 206, C"-D" 207, C'-D'" 208, E'-F' 209 and E"-F" 210. These central lines are all parallel to the central vertical axis 100'. In this way, the first antenna bracket mounting formation 200 is in line with the single pivot axis mounting formation 300, the single pivot axis mounting formation 300 is in line with the second antenna bracket mounting formation 400 and the second antenna bracket mounting formation 400 is in line with the antenna system 500 and, all together, are absolutely perpendicular to the central vertical axis 100'. Therefore, the horizontal (azimuth), vertical (tilt) and adjacent vertical (roll) heading of the antenna system 500 is at a known, pre-calibrated, 3-dimentional "home position", with respect to the antenna structure central vertical axis 100'.

Figure 2:
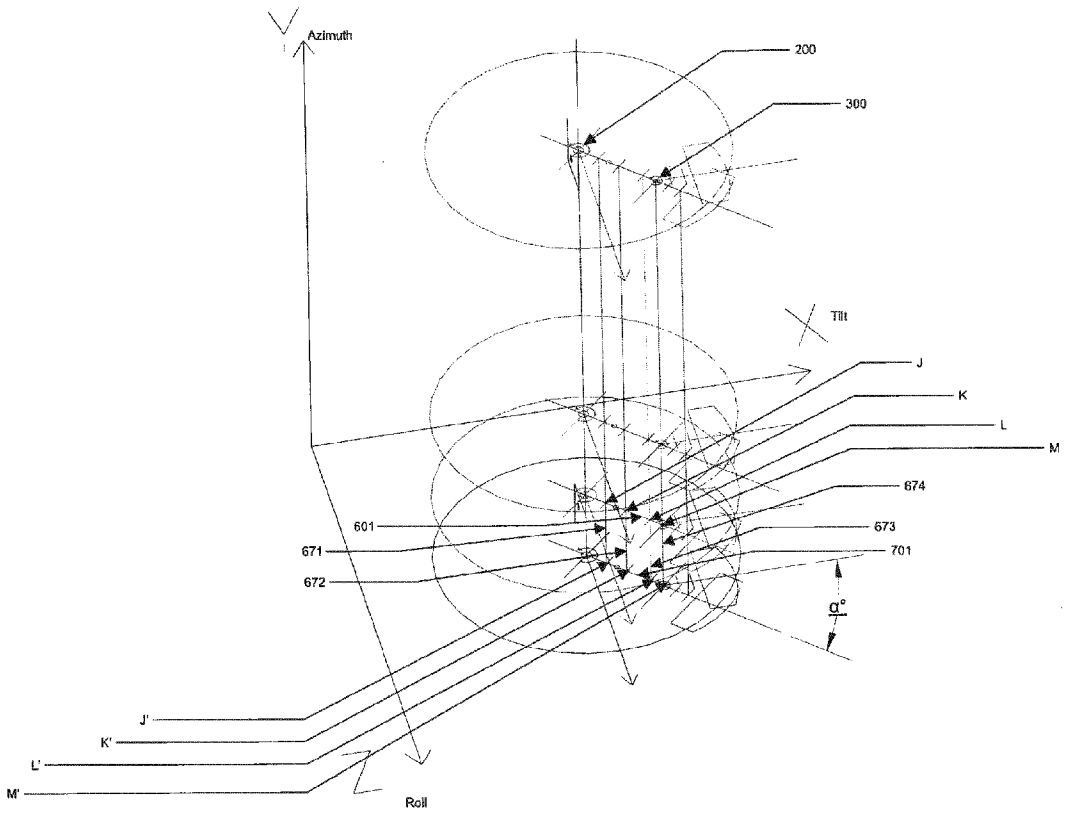
FIG. 2 is a perspective view of a reference point system for a single sector antenna structure.

FIG. 2 shows a perspective view of a reference point system. Four points J, K, L, M form a line J-M 601 which is perpendicular to the central vertical axis 100' of the antenna structure. Four points J', K', L', M' form a line J'-M' 701 which is perpendicular to the central vertical axis 100' of the antenna structure. Additionally, points J, K, L, M, and the respective points J', K', L', M' are in pairs forming the respective lines J-J' 671, K-K' 672, L-L' 673, M-M' 674. These lines are all parallel to the central vertical axis 100'.

In order to align the central bottom mounting joints B', B'", D', D" that are located on the first antenna bracket mounting formation 200 with the single pivot axis mounting formation 300 up to the pivot axis central mounting joint D" to points J, K, L, M, the respective lines B'-J, B'"-K, D'-L and D"-M need to be formed in pairs. By ensuring that the lines B'-J, B'"-K, D'-L and D"-M are all parallel, and also parallel to the antenna structure central vertical axis 100', analysis and the imaginary transfer of the first antenna bracket mounting formation 200 and the single pivot axis mounting formation 300 up to the pivot axis central mounting joint D" (and vice versa) is achieved for horizontal (azimuth), vertical (tilt) and adjacent vertical (roll) heading in the reference point system.

With the aid of FIG. 1*a*, FIG. 1*b* and FIG. 2, a method of aligning an antenna system to a "home position", as well as a method of transferring the first antenna bracket mounting formation 200 and the single pivot axis mounting formation 300 up to the pivot axis central mounting joint D" to a reference point system with respect to an antenna structure has been described. As a result, and with reference to FIG. 2, the antenna system "home position" heading can be transferred and assessed on the reference point system, when the bottom mounting central joints B'-F" form a line. Since this line determines that the antenna system is in "home position", the J-M line on the reference point system can be assumed to represent the antenna system "home position". This is ensured by appropriate installation procedures when the lines J-M and B'-D" are parallel.

In order to determine the antenna system "home position" heading in the horizontal (azimuth), vertical (tilt) and adjacent vertical (roll) directions in terms of absolute values (as well as relative values as described above), the J-M line horizontal (azimuth), vertical (tilt) and adjacent vertical (roll) heading needs to be measured with respect to the grid or true north (i.e. azimuth determination) and with respect to the central earth gravity axis (i.e. tilt and roll determination) on the reference point system. Several prior art solutions are currently available for such measurements. For example, US20090021447 and US20110225804 describe devices for the accurate measurement of the orientation of an antenna system in three directions, i.e. azimuth, tilt and roll, which can be used for the purpose described herein.

After completing the antenna system heading "home position" measurements in the three directions, i.e. azimuth, tilt and roll, with respect to the grid or true north (to be called herein as GTN) and with respect to the central earth gravity axis (to be called herein as CGA), the next step is to determine the necessary actions to be performed in order for the antenna system heading to be aligned to desired azimuth, tilt and roll directionality angles provided by the radio planning process and installation work orders (to be referred to herein as "planned position"). Although the first configuration of our antenna system in the "home position" may take any azimuth, tilt and roll directionality angle in space after installation completion, for simplicity purposes assume that the "home position" angles of the antenna system heading are as follows:

antenna system azimuth in "home position"=$\alpha°$ HP
antenna system tilt in "home position"=$\beta°$ HP
antenna system roll in "home position"=$\gamma°$ HP Attempting to re-adjust the antenna system heading from "home position" to "planned position" results in an antenna system heading "home position" offset of $\alpha 1°$ OFF, $\beta 1°$ OFF and $\gamma 1°$ OFF degrees for azimuth, tilt and roll respectively. Therefore, in order to achieve alignment of the antenna system "home position" heading to the desired "planned position" heading one may simply assume that the "planned position" angles of the antenna system heading are as follow:

antenna system azimuth in "planned position"=$\alpha°$ HP+/−$\alpha 1°$ OFF=$\alpha°$ PP
antenna system tilt in "planned position"=$\beta°$ HP+/−/$\beta 1°$ OFF=$\beta°$ PP
antenna system roll in "planned position"=$\gamma°$ HP+/−$\gamma 1°$ OFF=$\gamma°$ PP In the exemplary first configuration (as described with the reference to FIG. 1*a* and FIG. 1*b*) in order to meet the antenna system azimuth in "planned position", a rotation of the antenna system group, to be called herein as ASG, comprising the antenna system and its respective supporting parts, around the central vertical axis 100'), (referred to herein as CVA), needs to be performed. Alternatively or additionally, only the antenna system can be rotated, around the single pivot axis mounting formation 300. The antenna system group or the antenna system only needs to be rotated clockwise or counterclockwise by the offset $\alpha 1°$ OFF in order to meet the antenna system azimuth in "planned position". In the case of rotating the antenna system group by the offset $\alpha 1°$ OFF, it can be realized that, after the re-adjustment of azimuth (planned azimuth=$\alpha°$ HP+/−$\alpha 1°$ OFF=$\alpha°$ PP), the initial antenna system "home position" measurement taken for tilt (tilt=$\beta°$ HP) and roll (roll=$\gamma°$ HP) angles, are no longer valid and need to be re-measured or re-calculated if the tilt angle $\beta°$ HP$\neq 0°$ and the roll angle $\gamma°$ HP$\neq 0°$. This is due to the fact that the "home position" tilt (tilt=$\beta°$ HP where $\beta°$ HP$\neq 0°$) and roll (roll=$\gamma°$ HP where $\gamma°$ HP$\neq 0°$) angles on the antenna system group have been measured with respect to the central gravity axis (CGA) for a specific antenna system group (ASG) azimuth heading with respect to the central vertical axis 100' of the antenna structure. The same issue arises when the antenna system is rotated around the single pivot axis mounting formation 300.

By way of example, let us assume that the antenna system group "home position" is headed at an angle α° HP with respect to grid or true north (GTN). When the antenna system azimuth is offset (provided by the radio planning process and installation work orders) at +90° (i.e. α1° OFF=+90°) from "home position" and the tilt angle and roll angles occupy "home position" (tilt=β° HP where β° HP≠0° roll=γ° HP where γ° HP≠0°), then the antenna system tilt and roll angles at the "planned position" azimuth angle (planned azimuth=α° HP+90°=α° PP) shall be equal to γ° HP and β° HP respectively. This is due to the fact that, when the antenna system is rotating its azimuth heading from "home position" to "planned position", the antenna system performs this movement over the central vertical axis (CVA) of the antenna structure. On top, knowing that the tilt plane and roll plane, by the aforementioned installation, are always perpendicular to the azimuth plane and always perpendicular to the central vertical axis (CVA) of the antenna structure, the antenna system heading on tilt plane will always be perpendicular to the antenna system heading on roll plane. The result of this is that, for every azimuth heading offset of +90° or −90° from the "home position", the tilt and roll angles with respect to the central gravity axis (CGA) will reverse (i.e. the "home position" tilt angle β° HP where β° HP≠0° and the "home position" roll angle=γ° HP where γ° HP≠0°) such that the antenna system tilt and roll angles at the "planned position" azimuth angle (planned azimuth=α° HP+/−90°=α° PP) shall be equal to γ° HP and β° HP respectively).

Similarly, when the antenna system azimuth offset (provided from the radio planning process and installation work orders) is +180° or −180° (i.e. α1° OFF=+/−180°) from "home position" and the "home position" tilt angle=β° HP where β° HP≠0°) and the "home position" roll angle=γ° HP where γ° HP≠0°), then the antenna system tilt and roll angles at the "planned position" azimuth angle (planned azimuth=α° HP+/−180°=α° PP) shall be equal to −β° HP and −γ° HP respectively. Therefore, in order to achieve accurate re-alignment of the antenna system "home position" heading to the desired "planned position" heading for all three dimensions of interest, it can be realized that one cannot simply assume the calculation of the offset introduced for azimuth, tilt and roll angles in the "planned position", having as reference the installed antenna system or antenna system group in "home position". This assumption can only be applied in the case that the antenna structure, and more specifically, the central vertical axis (CVA) of the antenna structure after its installation, coincides with the central gravity axis (CGA) that defines the tilt and roll angles of the antenna system or antenna system group in the "home position", i.e.:

antenna system azimuth in "home position"=α° HP antenna system tilt in "home position"=0° antenna system roll in "home position"=0°

Since it cannot be ensured from any installation procedure that the installation of an antenna structure, and more specifically the antenna structure's central vertical axis (CVA), will coincide with the central gravity axis (CGA), and since such installation imperfections will always be present in cellular communications network roll-outs, one needs to take into account the installation imperfections introduced and calculate the "home position" tilt angle for tilt=β° HP where βHP≠0° and the "home position" of roll angle for roll=γ° HP where γ° HP≠0°, for any azimuth angle at "planned position" displaced in between 0° and 360° on the azimuth plane with respect to "home position" in order to achieve antenna system re-alignment accuracy for any purpose.

Figures 3A, 3B:
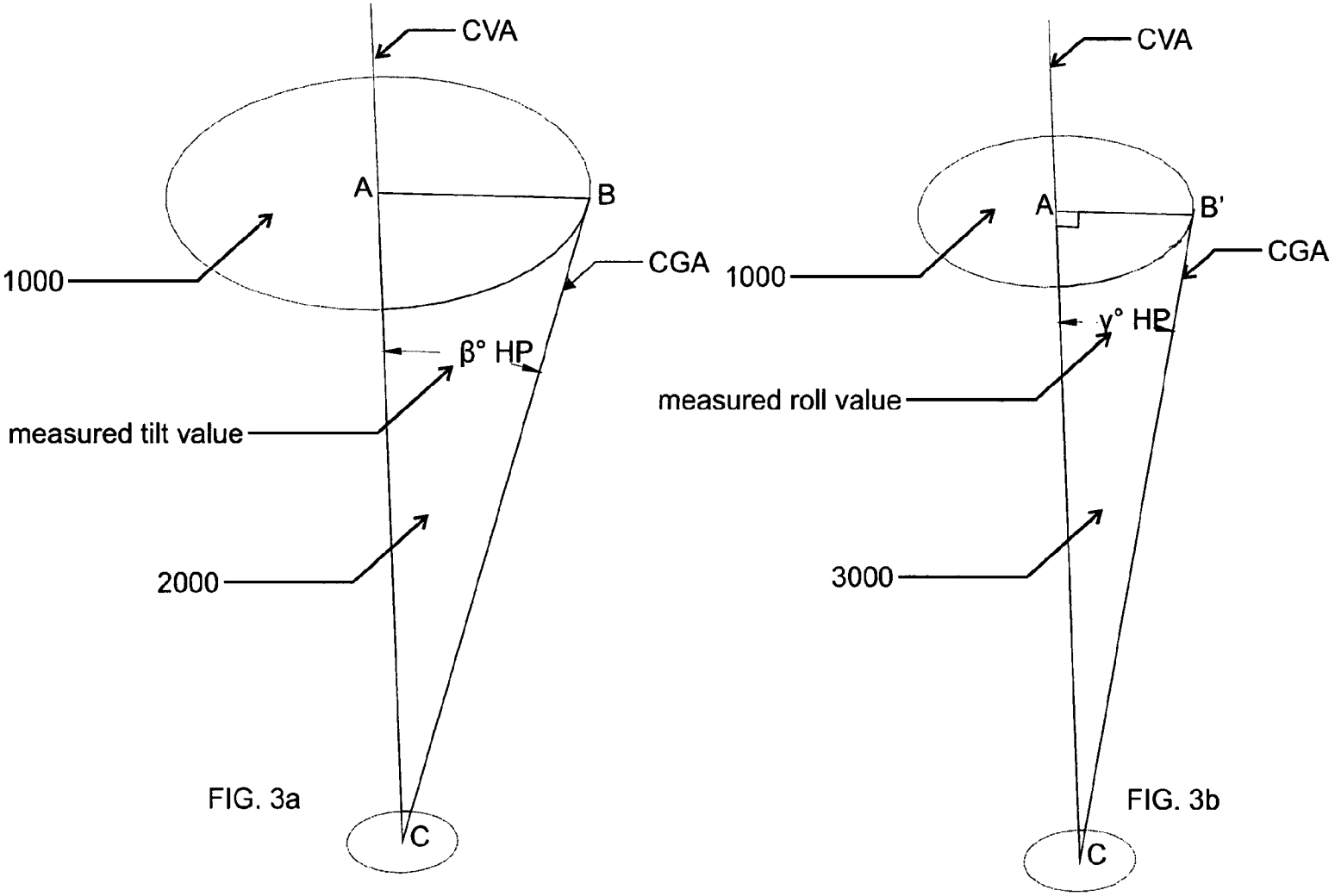
FIG. 3*a* is a perspective view of an azimuth and tilt plane.
FIG. 3*b* is a perspective view of an azimuth and roll plane.

The three dimensional antenna system alignment problems described in the previous paragraphs for azimuth re-adjustment can be overcome when an antenna system alignment algorithm, defining the relationship of the antenna system heading from "home position" to "planned position" for azimuth, tilt and roll heading angles, is applied at antenna system installation and any antenna system re-adjustment phase. FIG. 3*a* and FIG. 3*b* show perspective views of azimuth and tilt plane and azimuth and roll plane respectively. Specifically, FIG. 3*a* shows the antenna system group azimuth heading α° HP (depicted as AB on azimuth plane 1000) in "home position" with respect to the antenna system tilt angle (β° HP) on tilt plane 2000 in "home position", the central gravity axis CB and its offset with the antenna structure central vertical axis AC (indicating the tilt installation imperfection angle β HP, with respect to the central gravity axis CB).

FIG. 3*b* shows the antenna system group azimuth heading α° HP (shown as AB' on azimuth plane 1000) in "home position" with respect to the antenna system roll angle (γ° HP) on roll plane 3000 in "home position", the central gravity axis CB' and its offset with the antenna structure central vertical axis AC (indicating the roll installation imperfection angle γ° HP with respect to the central gravity axis CB). Since azimuth, tilt and roll planes are, due to care during installation, perpendicular to each other and parallel to the antenna structure central vertical axis (CVA), one may form a three-dimensional view of the antenna system group tilt and roll installation imperfections with respect to the central gravity axis (CGA) for any azimuth angle applied clockwise or counterclockwise around the central vertical axis (CVA).

Figure 3C:
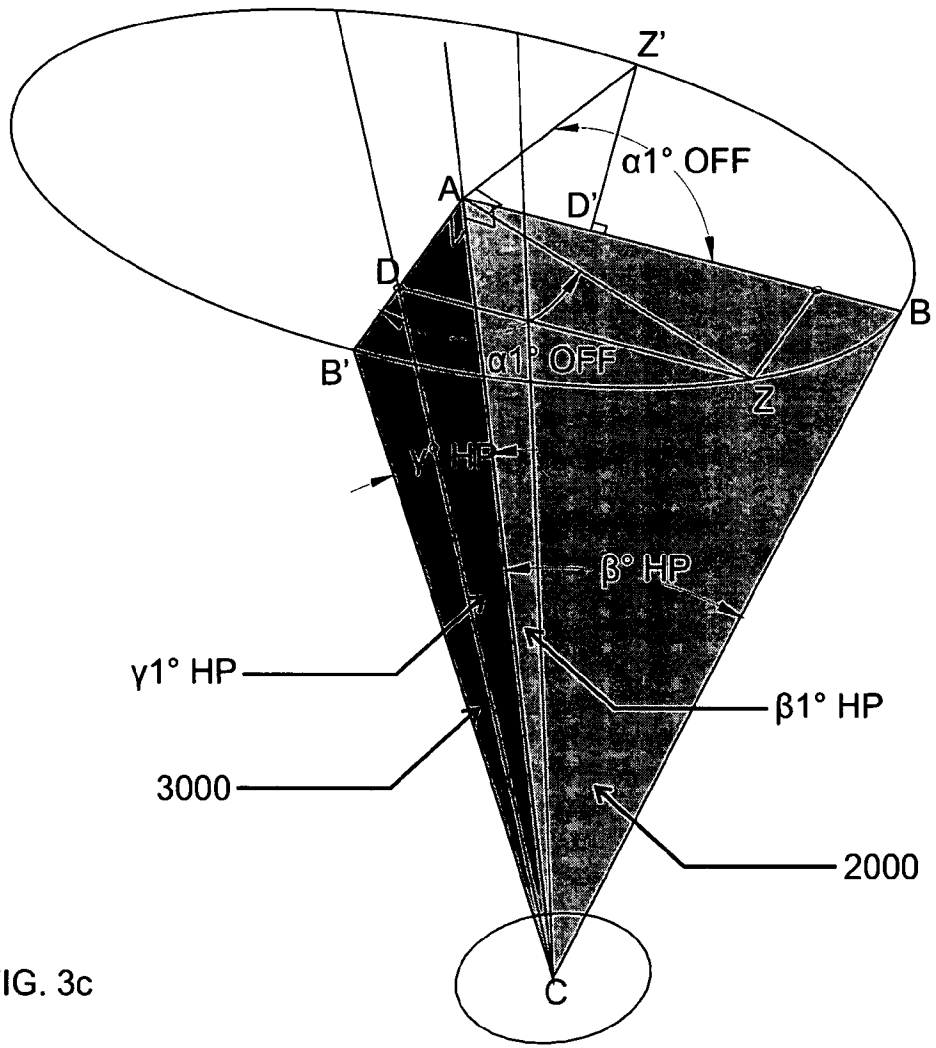
FIG. 3*c* is a schematic perspective view of an antenna system showing tilt and roll angles.

FIG. 3*c* shows the antenna system group tilt and roll angles (β° HP and γ° HP) for antenna system group azimuth heading α° HP (depicted as AB and AB' on the perpendicular cross section of tilt and roll planes on the azimuth plane respectively). For any antenna system group azimuth heading α° PP at "planned position", AZ' and AZ depict the newly formed tilt and roll angles respectively at α1° OFF away from their "home position". In order to calculate the newly formed tilt and roll angles at α1° OFF away from their "home position", one needs to form the projections of Z' and Z points on AB and AB' lines respectively. After doing so, the lines AD' and AD are formed, thus indicating the newly introduced tilt and roll angles with reference to the tilt and roll initial angles (depicted by the AB and AB' lines) at α1° OFF away from their "home position". In this way, the newly formed tilt and roll angles "home position" β1° HP and γ1° HP at α1° OFF away from their initial setting can be calculated. Completing the antenna system three dimensional alignment from "home position" to "planned position", by having the azimuth at α° PP, the tilt and roll angles in the "home position" now become:

TILT @ "home position" after α1° OFF=β1° HP

ROLL @ "home position" after α1° OFF=γ1° HP

Therefore, in order to achieve accurate alignment from the antenna system "home position" to the desired "planned position", one may calculate the "planned position" angles of the antenna system heading as follow:

antenna system azimuth in "planned position"=α° HP+/−α1° OFF=α° PP antenna system tilt in "planned position"=β1° HP+/−β1° OFF=β° PP antenna system roll in "planned position"=γ1° HP+/−γ1° OFF=γ° PP It is to be noted that the radio planning process and installation work orders do not necessarily provide antenna system roll heading angles as they always assume successful antenna system installation on the roll plane and, as a result, assume roll directionality to be 0° with respect to the central gravity axis (CGA). Since an antenna system roll heading other than 0° would only impact the polarization angle of the antenna system dipoles (i.e. E-Field directionality), such a radio planning parameter and thus roll angle further degrees of freedom for installation error compensation are not discussed herein. However, any roll angle re-adjustment methods need not be considered standalone, because they are relevant to the antenna system azimuth and tilt heading at "planned position" when and if needed. The method of the present invention are particularly beneficial when applied to a dual pivot axis system in order to calculate installation imperfections of an antenna structure.

FIG. 4*a* shows a plan view of a single sector antenna system in "home position". Whilst the 'home position' of the antenna is shown in FIG. 4 in the azimuth direction, it will be appreciated that in such a 'home position', the joints of the antenna are aligned as discussed above to ensure the tilt and roll planes are perpendicular to the azimuth plane. The antenna structure comprises a first antenna bracket mounting formation 200 which is attached to single pivot axis mounting formation 300. The single pivot axis mounting formation 300 is attached to a second antenna bracket mounting formation 400, and the second antenna bracket mounting formation 400 is attached to a panel antenna system 500. In this exemplary configuration, the antenna system can be rotated, around the single pivot axis mounting formation 300 by at maximum 120° (i.e. −60° to 0° as shown in FIG. 4*b* and 0° to +60° as shown in FIG. 4*c*) with respect to its home position α° HP. After completing the antenna system heading "home position" measurements in the direction of azimuth with respect to the grid or true north (absolute azimuth directionality), it can be seen from FIGS. 4*b* and 4*c* that the azimuth movement range of the antenna system 500, either clockwise 1100 or counterclockwise 1200, cannot satisfy the offset angle (α1° OFF) required to meet α° PP (defined by the radio planning and installation work orders)—i.e. α° HP+/−α1° OFF=α° PP. This is due to the fact that α° PP>α° HP, and that α° HP+(max clockwise antenna system movement range 1100)<α° PP.

In order to address this problem, a reference point on the antenna structure can be introduced, according to the teachings of WO2011042226, such that the antenna system group "home position" is aligned with respect to this reference point, and the reference point is aligned to some heading in the horizon with respect to GTN. The reference point on the antenna structure will be referred to herein as ABS. In the exemplary first configuration as described with reference to FIG. 4*a*, FIG. 4*b* and FIG. 4*c*, the antenna system azimuth "planned position" is achieved by rotating the first antenna bracket mounting formation 200 clockwise by α° PP−α° HP. In this way, antenna system alignment to "planned position", as well as maximum movement range around the "planned position" for future re-adjustments, is achieved. For installation similar to the one described herein, the reference point ABS has been selected in order to match the antenna system α° PP. In a general case, and to cover complex configurations (i.e. number of antenna systems=n, number of pivot axiss per antenna system=m) a special method need to be employed such that any installation parameters can be satisfied.

Even for relatively simple installation scenarios (like the one described above), the definition of the antenna system group "home position" with respect to ABS is an important aspect that needs to be considered when defining the antenna system group "home position" on the antenna structure. In an exemplary configuration comprising a triple antenna system, dual pivot axis per antenna system antenna structure, as shown in plan view in FIG. 5*a*, three antenna systems are aligned from their "home positions" α° $HP_1$, α° $HP_2$, α° $HP_3$. Additionally, both antenna system alignment to the desired radio planning and installation work order azimuth directionalities in the "planned positions" α $PP_1$, α° $PP_2$, α $PP_3$ as well as maximum movement range for each antenna system with respect to the "planned positions" for future radio planning and installation work order azimuth re-adjustments must be achieved.

Figure 5B:
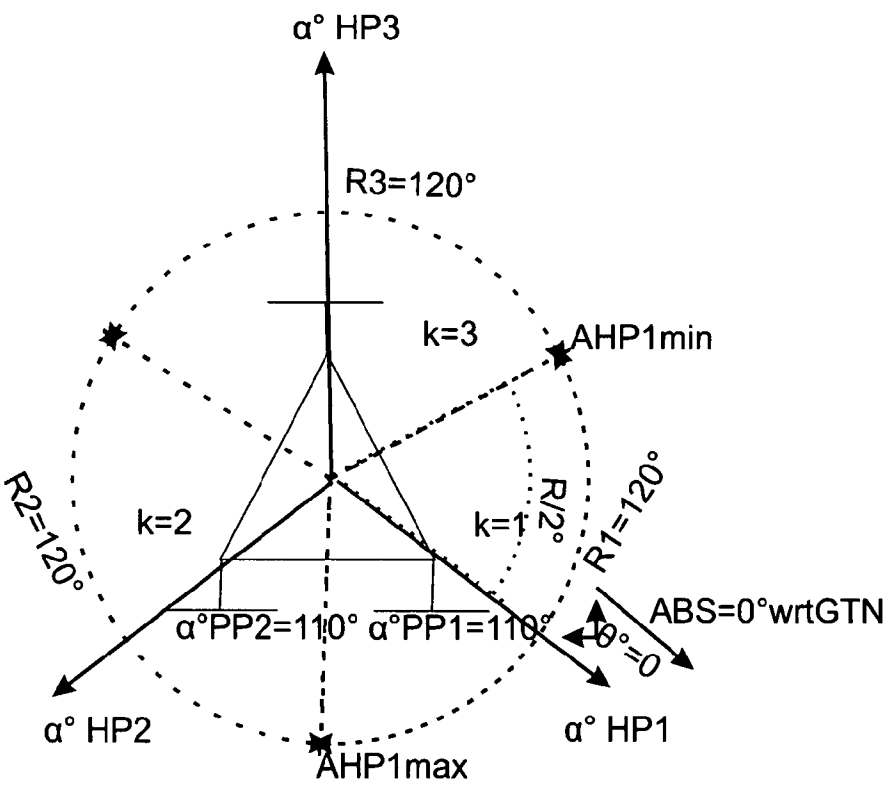
FIG. 5*b* is a further schematic plan view representation of an antenna system comprising three antenna sectors.
Figure 5A:
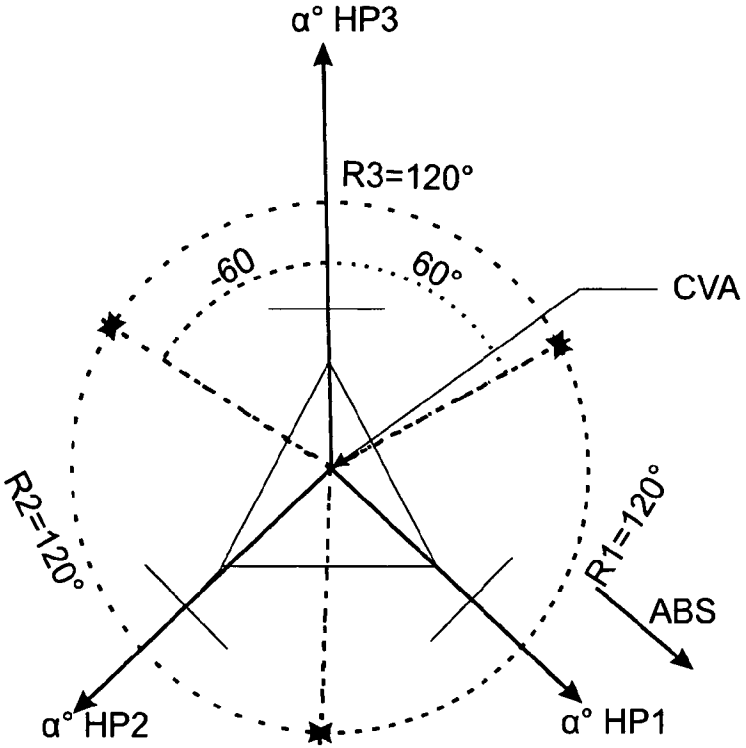
FIG. 5*a* is a schematic plan view representation of an antenna system comprising three antenna sectors.

As shown in FIG. 5*a*, the "home positions" of the antenna systems are arranged at 120° apart from each other, in such a way that the maximum movement range per antenna system attached on the antenna structure is the maximum possible (i.e. −60°≤α° HP≤+60°). This set up defines an antenna structure of three antenna systems with "home positions" α° $HP_1$, α° $HP_2$, α° $HP_3$ and a movement range R1°=R2°=R3°=120° for each antenna system respectively. Assuming that a reference point on the antenna structure (ABS) has not been selected and correlated with any antenna system "home position", it may be considered that the three antenna systems are able to achieve any azimuth directionality defined by radio planning and installation work orders due to the fact that together they cover all 360° on the horizon on 120° equal slices. However, this is not possible as there are some combined antenna system directionalities that cannot be achieved. An example of such a case could be aligning the azimuth of two antenna systems to the same "planned position" (i.e. α° $PP_1$=α $PP_2$).

In the exemplary configuration as shown in FIG. 5*a* and FIG. 5*b*, the antenna system azimuth movement range is defined as α° $HP_{k\ min}$≤α° $HP_k$≤α° $HP_{k\ max}$ for each antenna system k=1 . . . n, where α° $HP_{k\ min}$=α° $HP_k$−R°/2 and α° $HP_{k\ max}$=α° $HP_k$+R°/2 for maximum permissible antenna system movement range R° where R°=R1°=R2°=R3° for each antenna system respectively. This means that, when n=3, for each antenna system attached on the antenna structure, the first antenna system "home position" will be α° $HP_1$=α°, the second antenna system "home position" will be α° $HP_2$=α° $HP_1$+R° and the third antenna system "home position" will be α° $HP_3$=α° $HP_1$+2R°. Therefore, all three antenna systems on the antenna structure are separated by an equal distance such that the movement range of each antenna system can be defined as follow:

$$\alpha^\circ HP_{1\ min}=\alpha^\circ HP_1-R^\circ/2 \text{ and } \alpha^\circ HP_{1\ max}=\alpha^\circ HP_1+R^\circ/2 \text{ where } \alpha^\circ HP_1=\alpha^\circ$$

$$\alpha^\circ PP_1=[\alpha^\circ-60^\circ\leq\alpha^\circ HP_1\leq\alpha^\circ+60^\circ] \qquad \text{Antenna System 1:}$$

$$\alpha^\circ HP_{2\ min}=\alpha^\circ HP_2-R^\circ/2 \text{ and } \alpha^\circ HP_{2\ max}=\alpha^\circ HP_2+R^\circ/2 \text{ where } \alpha^\circ HP_2=\alpha^\circ HP_1+R^\circ$$

$$\alpha^\circ PP_2=[\alpha^\circ+R^\circ-60^\circ\leq\alpha^\circ HP_2\leq\alpha^\circ+R^\circ-60^\circ] \qquad \text{Antenna System 2:}$$

$$\alpha^\circ HP_{3\ min}=\alpha^\circ HP_3-R^\circ/2 \text{ and } \alpha^\circ HP_{3\ max}=\alpha^\circ HP_3+R^\circ/2 \text{ where } \alpha^\circ HP_3=\alpha^\circ HP_1+2R^\circ$$

$$\alpha^\circ PP_3=[\alpha^\circ+2R^\circ-60^\circ\leq\alpha^\circ HP_3\leq\alpha^\circ+2R^\circ+60^\circ] \qquad \text{Antenna System 3:}$$

T correlating each antenna system $\alpha°$ $HP_1$, $\alpha°$ $HP_2$, $\alpha°$ $HP_3$ with a reference point ABS, we need to know the first antenna system $\alpha°$ $HP_1$ offset $\Theta°$ with respect to this reference point ABS. Assuming that the reference point ABS has an offset $\Theta°=\alpha°$ with our first antenna system "home position" $\alpha°$ $HP_1$ (i.e. $ABS+\Theta°=ABS+\alpha°=\alpha°$ $HP_1$) then the antenna system "home position" for all antenna systems, with respect to ABS will be $\alpha°$ $HP_1=ABS+\alpha°$, $\alpha°$ $HP_2=ABS+\alpha°+120°$, $\alpha°$ $HP_3=ABS+\alpha°+240°$. The next step is to define the reference point ABS to the absolute azimuth heading in the horizon with respect to GTN. Several prior art solutions are currently available for such measurements. For example, US20090021447 and US20110225804 describe a device for the accurate measurement of the orientation of an antenna system in three directions, i.e. azimuth, tilt and roll which can be used for the purpose described herein.

By way of example, if we assume that the reference point ABS coincides with our first antenna system "home position" $\alpha°$ $HP_1$ (i.e. $\Theta°=0°$) and $ABS=0°$ with respect to GTN, the assigned ABS (i.e. $ABS=0°$) does not satisfy the orientation of two antenna systems to achieve the azimuth directionality defined by radio planning and installation work orders for $\alpha$ $PP_1=\alpha°$ $PP_2=110°$. This is because the first antenna system has movement range of 0° to 120° [$-60°\leq\alpha°$ $HP_1\leq+60°$ ] (and therefore can be oriented at 110°) and the second antenna system has movement range of 120° to 240° [$+60°\leq\alpha°$ $HP_2\leq+180°$ ] (and therefore cannot be oriented at) 110°. In order to address this problem, it is necessary to select the ABS heading with respect to GTN.

Figure 6:
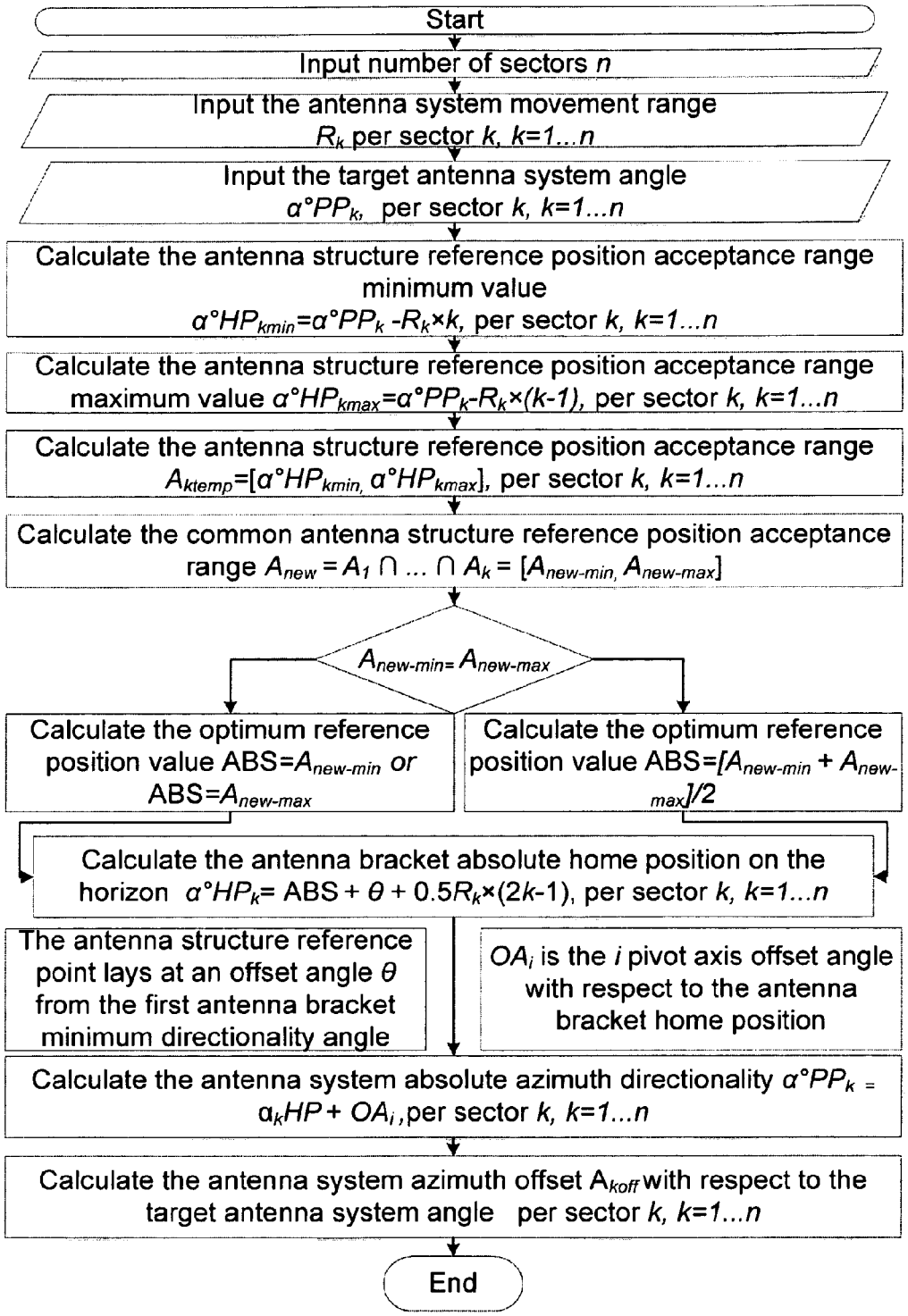
FIG. 6 is a flow diagram outlining antenna system installation method steps according to an embodiment.

The reference position utilized in the present invention is derived by the following procedure, graphically illustrated in FIG. 6. The parameters considered in the reference position computations involve the antenna system movement range, with respect to the "home position" on the antenna structure, the number of antenna systems, and the target horizontal (azimuth) directionality angles for each antenna system. Initially, the number n of the antenna systems attached to an antenna structure is obtained. In the mentioned example, the antenna structure reference point ABS lays at an angle equal to the first antenna system minimum directionality angle, with respect to the first antenna system "home position" on the antenna structure $\alpha°$ $HP_1$. For each antenna system k=1 . . . n, with maximum permissible antenna system movement range R and target horizontal (azimuth) directionality angle $\alpha°$ $PP_k$, an antenna structure reference position acceptance range extending from $\alpha°$ $HP_{kmin}$ to $\alpha°$ $HP_{kmax}$ may be computed by $\alpha°$ $HP_{kmin}=\alpha°$ $PP_k-R\times k$ and $\alpha°$ $HP_{kmax}=\alpha°$ $PP_k-R\times(k-1)$. For example, considering n=3 antenna systems with maximum permissible antenna system movement range R=120°, the corresponding temporary antenna structure reference position acceptance ranges are:

$$\alpha° HP_{1min}=\alpha° PP_1-120 \text{ and } \alpha° HP_{1max}=\alpha° PP_1, \text{ i.e. } A1_{temp}=[\alpha° PP_1-120, \alpha° PP_1]$$

$$\alpha° HP_{2min}=\alpha° PP_2-240 \text{ and } \alpha° HP_{2max}=\alpha° PP_2-120, \text{ i.e. } A2_{temp}=[\alpha° PP_2-240, \alpha° PP_2-120]$$

$$\alpha° HP_{3min}=\alpha° PP_3-360 \text{ and } \alpha° HP_{3max}=\alpha° PP_3-240, \text{ i.e. } A3_{temp}=[\alpha° PP_3-360, \alpha° PP_3-240].$$

Having calculated the temporary antenna structure reference position acceptance range for each antenna system k attached to an antenna structure, a new antenna structure reference position acceptance range is computed by intersecting the temporary antenna structure reference position acceptance ranges, as $$A_{new}=A1_{temp}\cap A2_{temp}\cap A3_{temp}.$$

The optimum reference position value ABS, in the sense that it ensures maximum permissible antenna system movement range, needed for future azimuth re-adjustments, for either a single pivot axis or dual pivot axis antenna systems attached to the antenna systems, with respect to the installed horizontal (azimuth) directionality angles, is calculated by computing the new antenna structure reference position acceptance range mean value as:

$$ABS=(A_{new\ min}+A_{new\ max})/2.$$

The antenna systems attached to an antenna structure are then aligned or pre-calibrated to the antenna structure reference point ABS. The parameters considered in the antenna system "home position" computations involve the antenna system movement range, with respect to the antenna system "home position" on the antenna structure and the number of antenna systems. In the same example, the antenna structure reference point ABS lays at an angle equal to the first antenna system minimum directionality angle, with respect to the first antenna system "home position" on the antenna structure. For each antenna system k=1 . . . n, with maximum permissible antenna system movement range R°, an antenna system "home position" on the antenna structure according to which the antenna system movement range is calibrated may be computed by $\alpha°$ $HP_k=0.5R\times(2k-1)$. In a second example, the antenna structure reference point ABS lays at an offset angle $\theta°$ from the first antenna system minimum directionality angle, with respect to the first antenna system "home position" on the antenna structure. For each antenna system k=1 . . . n, with maximum permissible antenna system movement range R°, an antenna system "home position" on the antenna structure according to which the antenna system movement range is calibrated may be computed by $\alpha°$ $HP_k=\theta+0.5R\times(2k-1)$.

For n=3 antenna systems with maximum permissible antenna system movement range R°=120° attached to an antenna structure are aligned or pre-calibrated to the antenna structure reference point ABS at 60°, 180° and 300°. Otherwise stated, the antenna system "home positions" are thus aligned or pre-calibrated to the antenna structure reference point at 60°, 180° and 300°. As a further example, the n=6 antenna systems with maximum permissible antenna system movement range 60° attached to an antenna structure are aligned or pre-calibrated to the antenna structure reference point at 30°, 90°, 150°, 210°, 270° and 330°. Otherwise stated, the antenna system "home positions" are thus aligned or pre-calibrated to the antenna structure reference point ABS at 30°, 90°, 150°, 210°, 270° and 330°.

An alignment device such as the one described in US20110225804A1 may be fixedly attached to the antenna structure reference point to determine the absolute azimuth, tilt and roll antenna structure reference point directionality with respect to GTN and CGA. The use of an alignment device to undertake the antenna structure reference point alignment with respect to the reference position may result in a precise antenna system alignment with minimum inaccuracy (less than) ±1° with respect to the specified horizontal (azimuth) and vertical (tilt) directionality angles provided from the radio planning process and installation work order. A skilled reader will recognize that other means of absolute azimuth, tilt and roll directionality measurement may be utilized for the same purpose. Thus, the result is an absolute directionality positioning of the antenna structure reference point when an alignment device is attached thereto. Advantageously, the antenna structure reference point is arranged or otherwise positioned in accordance with the calculated reference position ABS.

In another exemplary implementation, the antenna structure reference point may be aligned, in accordance to the present invention, to a calculated reference position of ABS, following the process outlined in FIG. 6, as such, the antenna structure reference point lays at an angle equal to the first antenna system minimum directionality angle, with respect to the first antenna system home position on the antenna structure. For each antenna system k=1 . . . n, with maximum permissible antenna system movement range R, an antenna system absolute home position on the horizon according to which the antenna system movement range is calibrated may be computed by $\alpha^\circ\ HP_k=ABS+0.5R\times(2k-1)$. In another implementation, the antenna structure reference point lays at an offset angle θ from the first antenna system minimum directionality angle, with respect to the first antenna system home position on the antenna structure. For each antenna system k=1 . . . n, with maximum permissible antenna system movement range R, an antenna system absolute home position on the horizon according to which the antenna system movement range is calibrated may be computed by $\alpha^\circ\ HP_k=ABS+\theta+0.5R\times(2k-1)$.

The computations performed to calculate the antenna systems' first and/or second pivot axis offset with respect to the antenna systems home positions, in order to achieve the target horizontal (azimuth) directionality angles for each antenna system and the antenna system thereto attached are outlined in FIG. 6. The parameters considered in the antenna systems' first and/or second pivot axis offset computations involve the antenna systems' absolute home position, the antenna systems' first and/or second pivot axis movement range with respect to the associated antenna system home position on the antenna structure and the target horizontal (azimuth) directionality angles for each antenna system. Generally, an antenna system absolute azimuth, tilt and roll directionality may be calculated by summing the antenna structure reference point directionality plus the known offset of the aligned or pre-calibrated antenna system azimuth, tilt and roll directionality with respect to the antenna structure reference point azimuth, tilt and roll directionality plus or minus the antenna systems' first and/or second pivot axis offset with respect to the antenna systems home positions.

In one embodiment of the present invention, the antenna structure reference point may be aligned, in accordance to the present invention, to a calculated reference position of ABS, following the process illustrated in FIG. 6. The antenna structure reference point directionality may preferably be equal to the calculated reference position to so that an even or about even distribution of the allowable antenna system movement range in both clockwise and counter-clockwise directions with respect to the corresponding antenna system target horizontal (azimuth) directionality angle may be attained.

In one example mode of implementation, the antenna structure reference point lays at an angle equal to the first antenna system minimum directionality angle, with respect to the first antenna system home position on the antenna structure. For each antenna system k=1 . . . n, with maximum permissible antenna system movement range R, an antenna system absolute home position on the horizon according to which the antenna system movement range is calibrated may be computed by $\alpha^\circ\ HP_k=ABS+0.5R\times(2k-1)$. For each antenna system k=1 . . . n, with maximum permissible antenna system movement range R, having a first pivot axis with maximum permissible movement range $R_1$ and/or a second pivot axis with maximum permissible movement range $R_2$ such that $R=R_1+R_2$, the antenna system absolute azimuth directionality may be computed by $\alpha^\circ\ PP_k=\alpha^\circ\ HP_k+OA_1+OA_2$, where $OA_1$, $OA_2$ are the first pivot axis and/or a second pivot axis offset angles with respect to the antenna system home positions.

In an exemplary embodiment of the present invention, the n=3 antenna systems with maximum permissible antenna system movement range 120° attached to an antenna structure are aligned or pre-calibrated to the antenna structure reference point at 60°, 180° and 300. Given the target directionality angles $\alpha^\circ\ PP_1=110^\circ$, $\alpha^\circ\ PP_2=110^\circ$ and $\alpha^\circ\ PP_3=320^\circ$, the antenna structure reference point may be aligned, in accordance to the present invention, to a calculated reference position ABS of 350°. For each antenna system k=1, 2, 3 with maximum permissible antenna system movement range 120°, an antenna bracket absolute home position on the horizon according to which the antenna bracket movement range is calibrated may be computed by $$\alpha^\circ\ HP_1=350^\circ+0.5\times120\times(2-1)=50^\circ.$$

$$\alpha^\circ\ HP_2=350^\circ+0.5\times120\times(4-1)=170^\circ.$$

$$\alpha^\circ\ HP_3=350^\circ+0.5\times120\times(6-1)=290^\circ.$$

It can be seen that ABS should always calculated according to workflow of FIG. 6 so as to satisfy radio planning and installation work orders in order to achieve multi antenna system (i.e. k=n) azimuth alignment to "planned positions" and also maximum movement range around the "planned position" for future azimuth re-adjustments. The ABS should be located on the reference point system attached on the antenna structure for alignment purposes. As described, the proposed method for enabling the accurate alignment and repeatable alignment with accuracy of communication antenna systems comprises ten steps as follows:

(10) Antenna system group alignment on an antenna structure CVA

(11) Reference point system alignment on an antenna structure CVA

(12) Antenna system imaging and surveying on reference point system

(13) Measurement of reference point system directionality of azimuth, tilt and roll with respect to GTN and CGA respectively on a selected reference point ABS of known offset Θ° with respect to the first antenna system image on the reference point system

(14) Calculation of the antenna systems on the reference point system with respect to the selected reference point ABS measured azimuth, tilt and roll

(15) Assignment of antenna systems azimuth, tilt and roll directionalities with respect to GTN and CGA at "home position"

(16) Re-adjustment of antenna system azimuth heading from "home position" to "planned position" according to radio planning and installation work orders

(17) Computation of "new" tilt and roll directionalities after azimuth re-adjustment with respect to the "home position" directionalities measured on the reference point system

(18) Assignment of antenna system tilt and roll directionalities with respect to CGA at "home position" on re-adjusted azimuth heading with respect to GTN on "planned position"

(19) Re-adjustment of antenna system tilt and roll directionality from "home position" to "planned position" according to radio planning and installation work orders In order to apply the method of FIG. 6 and also achieve accurate and repeatable with accuracy alignment of communication antenna systems without the need for a technician, rigger or climber to come in direct contact with the antenna system itself, an apparatus is proposed herein that is attached on an antenna bracket (1). The apparatus is capable of remote azimuth re-adjustment of an antenna system (2), remote tilt re-adjustment of an antenna system (3), and can receive the reference point system measurements performed for azimuth tilt and roll headings in "home position" (4). The apparatus is also capable to compute the installation imperfection offset introduced on the antenna system tilt and roll headings in "home position" with respect to the ideal (i.e. tilt=0° and roll=0°) (5), calculate the new antenna system tilt and roll headings in "home position" for any azimuth heading of the antenna system, the "planned position", and communicate with a remote user in order to perform all above actions (7).

Figure 10:
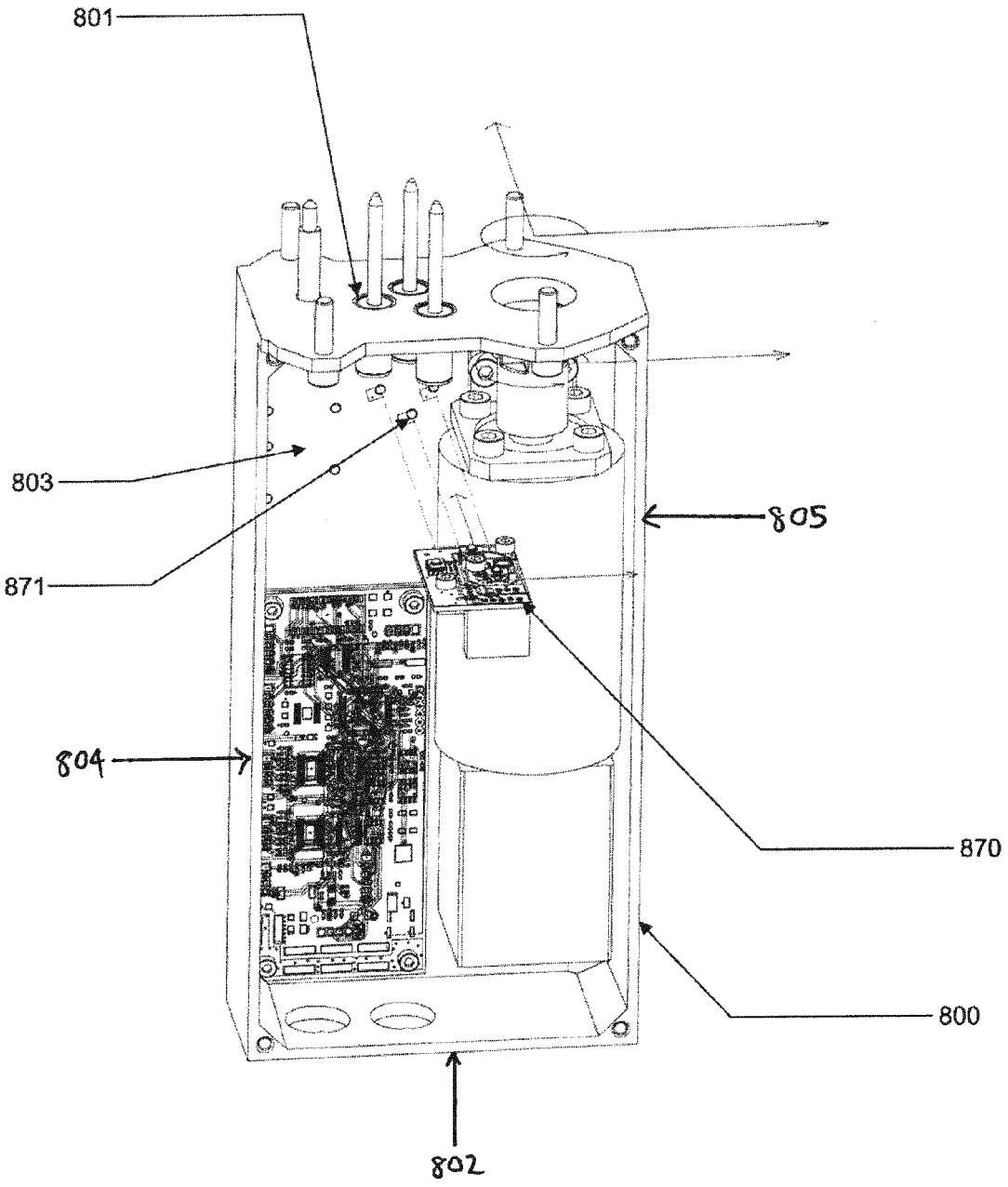
FIG. 10 is a cut-away diagram of an apparatus according to an embodiment.

FIG. 10 shows, as an exemplary configuration, a perspective, cut-away view of an apparatus according to the present invention. The apparatus includes a metal housing 800 having an upper wall 801, a lower wall 802, a removable front wall (not shown), a rear wall 803 and opposite side walls 804 and 805. The apparatus is appropriately attached on an antenna bracket so as to be uniquely positioned at the bottom of the antenna bracket pivot axis 300. This position facilitates field maintenance by engagement means which include four guide pins 320 for accurate positioning on the antenna bracket, such that when positioning the apparatus on the antenna bracket, the apparatus roll and tilt axis (X and Y respectively) are perpendicular to the antenna bracket pivot axis 300, thus ensuring the respective antenna bracket roll and tilt axis to be parallel to the apparatus roll and tilt axis. In this way, the apparatus is appropriately positioned on the antenna bracket to ensure it is perpendicular to the antenna system azimuth plane and parallel to the antenna system tilt and roll planes. Therefore, by the unique positioning of the apparatus on the antenna bracket, we may easily assign the azimuth, tilt and roll angles of the antenna system on the apparatus and vice versa. A prerequisite for such assignment is that the antenna system has been assembled on the antenna structure according to the method described above.

Figure 7:
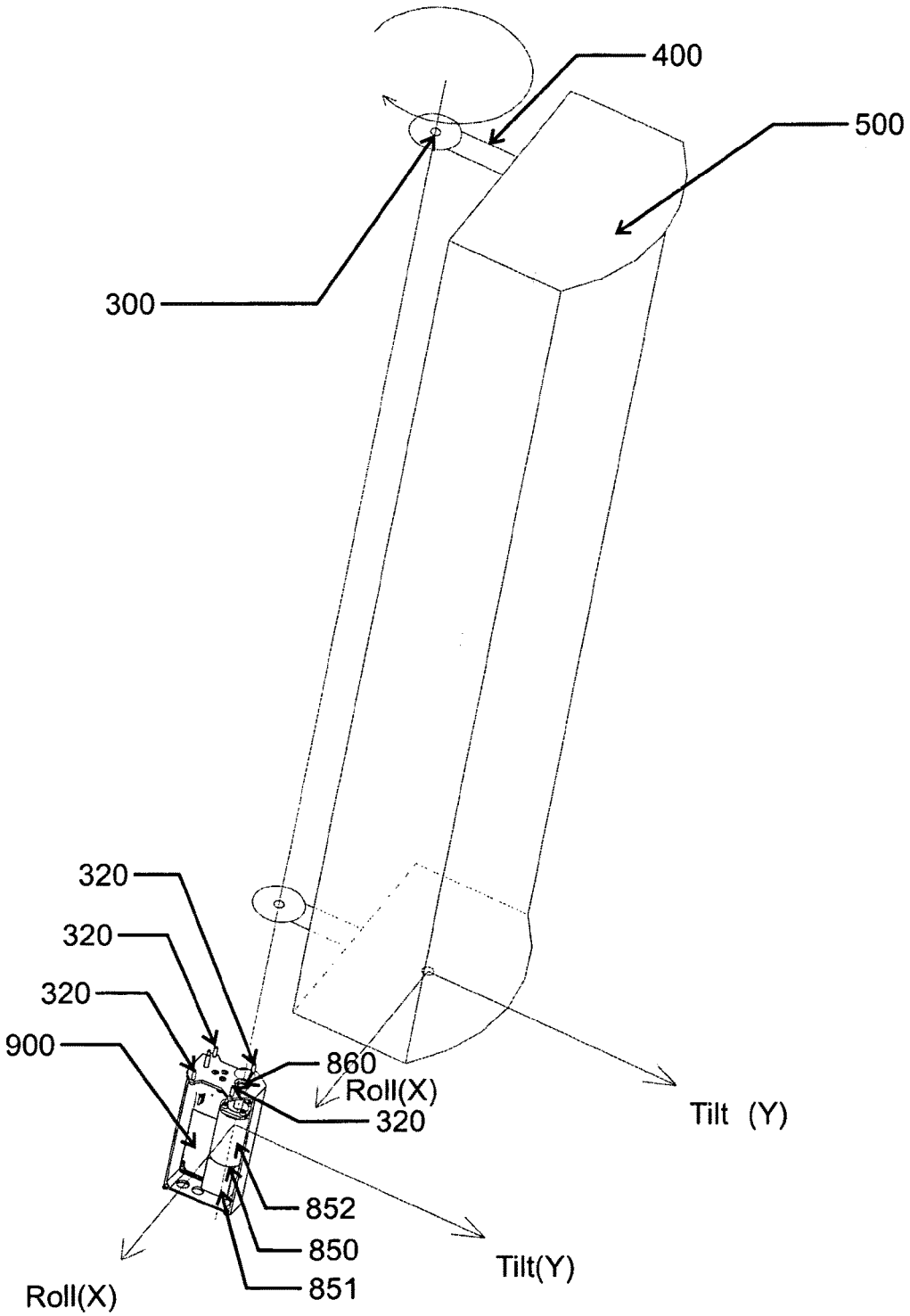
FIG. 7 is a perspective view of an antenna sector system according to an embodiment.

Referring now to FIG. 7, a drive unit 850, including a stepper motor 851 and a gearbox 852, allows remote control of the antenna bracket horizontal (azimuth) direction. The gearbox 852 is a minimum backlash high gear ratio planetary gear box that translates high speed, low torque motor rotation to lower speed, higher torque rotation of the drive gear turned by the stepper motor 851. A position detector (not shown), typically a potentiometer or an optical encoder which is driven by the pivot axis coupling unit 860, is located inside the stepper motor 851. Advantageously, an electrical potentiometer or an optical encoder to perform the measurements in the horizontal direction (azimuth) are both immune to external magnetic disturbances, such as the magnetic disturbances generated by the antenna system, antenna bracket and the antenna structure. The measurements performed by such devices are therefore highly accurate.

Figure 8:
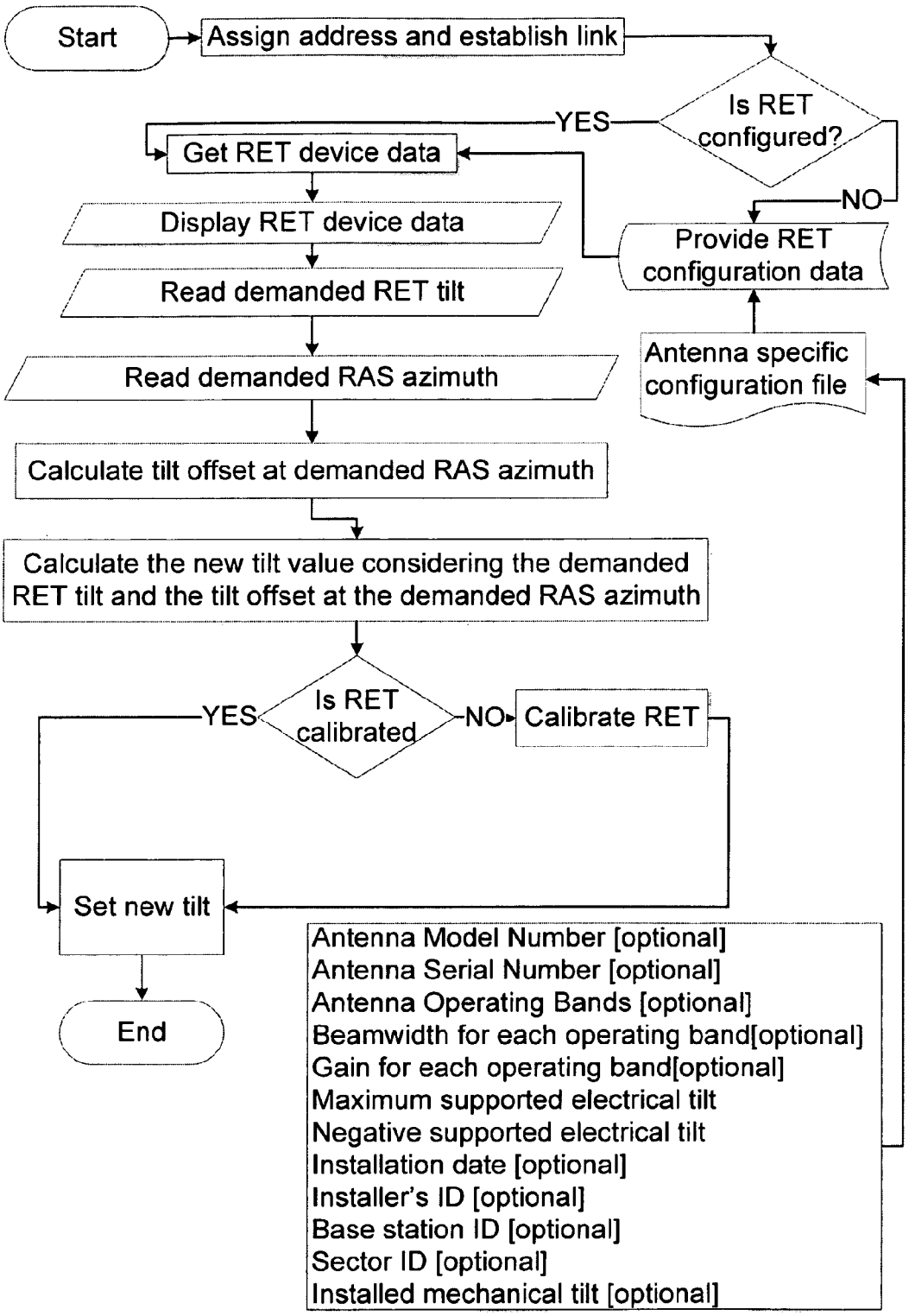
FIG. 8 is a flow diagram outlining the steps of tilt adjustment of an antenna.
Figure 9:
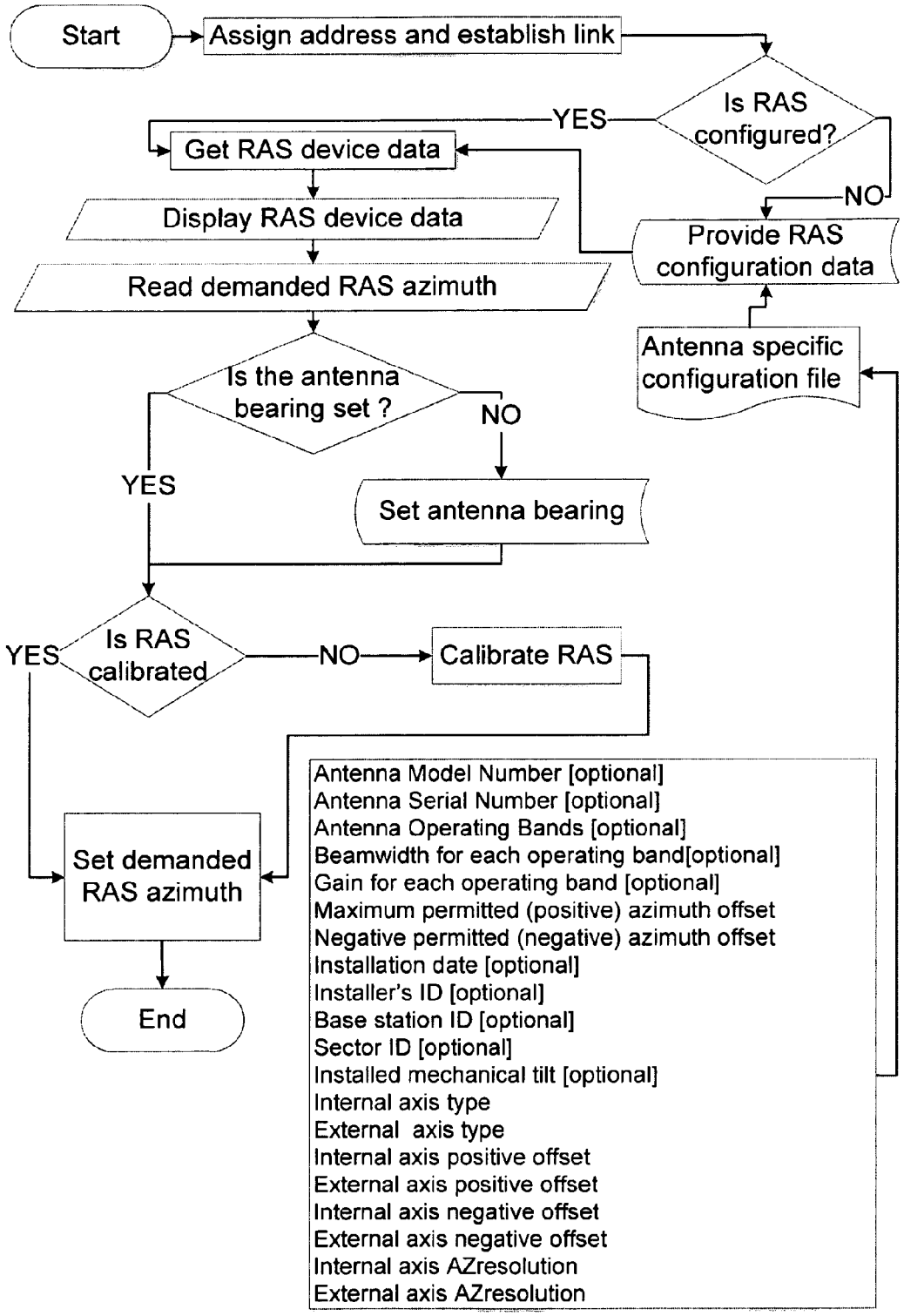
FIG. 9 is a flow diagram outlining the steps of azimuth adjustment of an antenna.

Azimuth adjustment is normally performed mechanically by moving the antenna around the antenna structure but could alternatively be performed electrically. Tilt re-adjustment is preferably performed by means of mechanical phase shifting of the dipoles feeding lines so as to adjust the direction of the radiation pattern in the tilt plane. Consequently, no further degrees of freedom, other than the electrical tilt options offered from the antenna system, will be described. Tilt adjustment may also be achieved by mechanical adjustment of the antenna. Similarly, roll adjustment may be performed mechanically or electrically. Often, however, roll adjustment is not required but measurement of the change to roll is still useful as it may affect future adjustments of azimuth or tilt. A printed circuit board (PCB) that serves the purpose of apparatus controller 900 is appropriately configured so as to perform all necessary Remote Electrical Tilt (RET) and Remote Azimuth Steering (RAS) apparatus operations by a sequence of steps as those are shown in FIG. 8 and FIG. 9 respectively:

Advantageously, the use of a PCB controller to compute all necessary azimuth, tilt and roll headings for the antenna system, as well as providing the means of remotely communicating with a remote user, enables the apparatus to interface to third party devices (such as the antenna system RET kit and other antenna line devices) and also does not require use of on-site inclinometer sensors for tilt an roll measurements.

Figure 11:
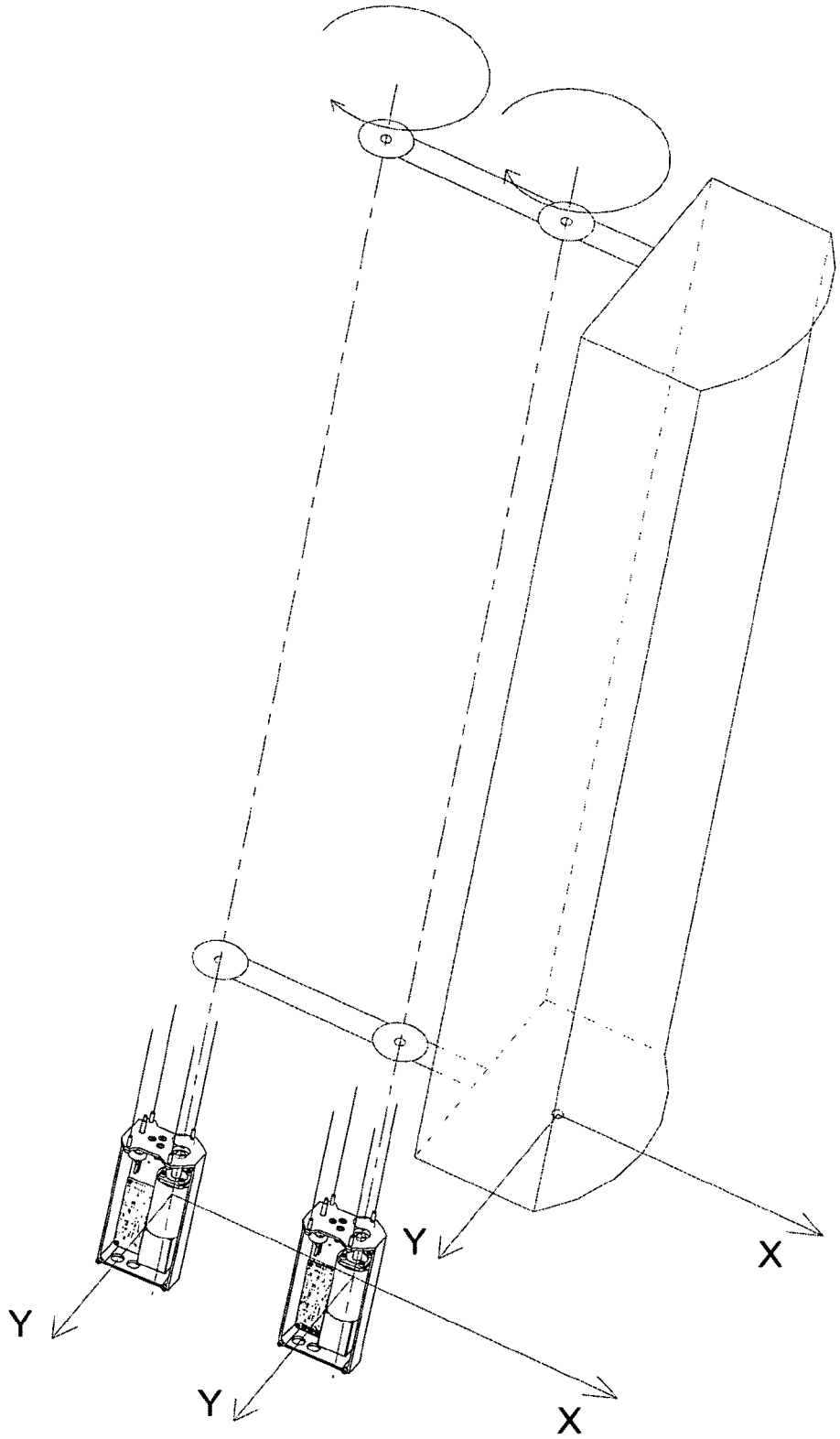
FIG. 11 is a perspective view of an antenna and apparatus of FIG. 10.

In an alternative configuration as shown in FIG. 10, one may include an inclinometer system (870) inside the apparatus metal housing (800), such that the inclinometer measurement roll and tilt axis (X and Y respectively) to be parallel to the apparatus roll and tilt axes (X and Y respectively) by installing a angle metal plate (871) perpendicular to rear metal wall (803) and parallel to the upper metal wall (801). The previous step ensures that the apparatus roll and tilt axes (X and Y respectively) are perpendicular to the antenna bracket pivot axis (300) while the respective antenna bracket roll and tilt axes (X and Y respectively) are parallel to the apparatus roll and tilt axes (X and Y respectively) thus parallel to inclinometer measurement roll and tilt axis (X and Y respectively). In this way it can be avoided the measurement of roll and tilt in the reference point system, providing further flexibility on the antenna system alignment method described herein at the cost of introducing an inclinometer system (870) inside the apparatus. In an alternative configuration as shown in FIG. 11, one may apply the teachings of the present invention with the use of two apparatus (one apparatus per pivot axe) on a dual pivot axis antenna system group.

Further aspects of the invention:

1. Apparatus for positioning an antenna pivotally attached about at a first pivot axis and a second pivot axis to a structure, comprising
   - at least a first motor system and a second motor system, wherein the first motor system is configured to effect movement of the antenna about the first pivot axis and the second motor system is configured to effect movement of the antenna about the second pivot axis, and
   - a control unit configured to control operation of each motor system, wherein the control unit is configured to calculate the extent of movement required by each motor system in order to produce a desired change in antenna position.

2. The apparatus of 1, wherein the first motor system comprises one or more measurement devices for measuring the extent of movement of the antenna sector about the first pivot axis and the second motor system comprises one or more measurement devices for measuring the extent of movement of the antenna sector about the second pivot axis, and preferably wherein measurements by each of the measurement devices are output to the control unit.

3. The apparatus of 2, wherein the control unit is configured to control operation of each motor system using measurements from the measurement devices.

4. The apparatus of any of 1 to 3, wherein the control unit is configured to store calibrated position data of the antenna sector.

5. The apparatus of 4, wherein the control unit is configured to control operation of each of the motor systems in order to position the antenna to a desired azimuth based on measurements from the measurement devices and the calibrated position data.

6. Apparatus for positioning an antenna pivotally attached about at a first pivot axis and a second pivot axis to a structure, comprising at least a first motor system and a second motor system, wherein the first motor system is configured to effect movement of the antenna about the first pivot axis and the second motor system is configured to effect movement of the antenna about the second pivot axis, and wherein the first motor system comprises one or more measurement devices for measuring the extent of movement of the antenna sector about the first pivot axis and the second motor system comprises one or more measurement devices for measuring the extent of movement of the antenna sector about the second pivot axis, and a data storage device, wherein the data storage device is configured to store measurements from each of the measurement devices.

7. The apparatus of 6, wherein the storage device is further configured to store calibrated position data of the antenna.

8. The apparatus of 7, wherein the first motor system is arranged to effect movement of the antenna about the first pivot axis and the second motor system is arranged to effect movement of the antenna about the second pivot axis based on a calculation of the current position of the antenna from calibrated position data of the antenna and measurements from each of the measurement devices stored in the storage device.

9. The apparatus of 6 or 7, further comprising a control unit in communication with the storage device, wherein the control unit is configured to control operation of each of the motor systems.

10. The apparatus of 9, wherein the control unit is configured to determine the current position of the antenna sector using calibrated position data and outputs from each of the measurement devices.

11. The apparatus of 10, wherein the storage device is further configured to store the current position of the antenna.

12. The apparatus of any of 6 to 11, further comprising user input means.

13. The apparatus of 6, wherein the control unit is configured to calculate a desired azimuth for the antenna sector using data input via the user input means.

14. The apparatus of 13, wherein the control unit is configured to control operation of the motor systems in order to position the antenna to the desired azimuth.

15. Apparatus for determining the alignment accuracy of an antenna mounted on an antenna sector having two pivoting axes, comprising:

at least two motor systems, wherein a first motor system comprises one or more measurement devices for measuring the extent of movement of the antenna sector about a first pivot axis and a second motor system comprises one or more measurement devices for measuring the extent of movement of the antenna sector about a second pivot axis, and wherein a value of a measurement by each measurement device has an associated predefined error value, and wherein the first motor system is arranged to effect movement about the first pivot axis and the second motor system is arranged to effect movement about the second pivot axis.

16. The apparatus of 15, further comprising a control unit, wherein the control unit is in communication with each of the motor systems.

17. The apparatus of 15 or 16, wherein the control unit is arranged to store calibrated position data of the antenna sector.

18. The apparatus of 17, wherein the control unit is configured to determine the position of the antenna using measurements from each of the measurement devices and calibrated position data.

19. The apparatus of 18, wherein the control unit is further configured to calculate the total error of the value of the determined position of an antenna in each of the X, Y and Z directions.

20. The apparatus of any of 6 to 19, wherein the measurement devices include at an optical encoder.

21. The apparatus 20, wherein the measurement devices further include a tilt sensor, a roll sensor, a motion calibrator and a potentiometer.

22. The apparatus of any of 6 to 21, wherein the control unit is further configured to determine the accuracy of the alignment of the antenna sector.

23. A motor system for effecting movement of an antenna sector about a pivot axis, comprising one or more measurement devices for measuring the extent of movement of the antenna sector about the pivot axis, wherein operation of the motor system is based on the measurements from each of the one or more measurement devices.

24. The motor system of 23, wherein the one or more measurement devices include an optical encoder, a tilt sensor, a roll sensor, a motion calibrator and a potentiometer.

25. The motor system of 23 or 24, wherein the motor system is in communication with a control unit, and wherein the control unit is arranged to control operation of the motor system using measurements from the measurement devices.

26. The motor system of 23 to 25, wherein a measurement by each of the one or more measurement device has a predefined associated error value.

27. A control unit for controlling movement of an antenna structure, comprising computer program code for executing the method of 1.

The invention claimed is:

1. A method of adjusting at least one cellular communications antenna mounted on an antenna structure, wherein the antenna, and/or direction of the radiation pattern of the antenna, is movable relative to the antenna structure, the method comprising the steps:

determining or retrieving current azimuth and tilt position values of the antenna or direction of the radiation pattern of the antenna;

receiving desired azimuth and tilt position values for the antenna or direction of the radiation pattern of the antenna relating to a desired position of the antenna or direction of the radiation pattern of the antenna;

calculating a tilt offset for the antenna or direction of the radiation pattern of the antenna based on the current tilt position value and the required movement of the antenna or direction of the radiation pattern of the antenna, relative to the antenna structure to reach the desired azimuth position value;

adjusting, using a remote azimuth steering operation and a remote electrical tilt operation, the azimuth and tilt position of the antenna or direction of the radiation pattern of the antenna, towards the desired azimuth and tilt position by moving the antenna or direction of the radiation pattern of the antenna, relative to the antenna structure based on the desired azimuth and tilt values and the calculated tilt offset.

2. The method of claim 1, further comprising determining or retrieving a current roll position value for the antenna or direction of the radiation pattern of the antenna.

3. The method of claim 2, further comprising receiving a desired roll position value and determining a roll offset for the antenna or direction of the radiation pattern of the antenna, based on the current roll position value and the required movement of the antenna relative to the antenna structure to reach the desired azimuth position value.

4. The method of claim 2, wherein determining or retrieving current azimuth, tilt and roll position values of the antenna or direction of the radiation pattern of the antenna comprises determining or retrieving the azimuth, tilt and roll position of the antenna or direction of the radiation pattern of the antenna, relative to the antenna structure and determining or retrieving the azimuth, tilt and roll position of the antenna structure relative to absolute values such as a global reference frame.

5. The method of claim 1, wherein adjusting the antenna or direction of the radiation pattern of the antenna, in an azimuth direction towards the desired position of the antenna or direction of the radiation pattern of the antenna comprises physically moving the antenna or direction of the radiation pattern of the antenna about a central vertical axis defined by the antenna structure which is not perfectly aligned with earth's central gravity axis.

6. The method of claim 5 wherein calculating the tilt offset for the antenna or direction of the radiation pattern of the antenna includes calculating a change in the absolute value in the tilt direction caused by a movement of the antenna or direction of the radiation pattern of the antenna in the azimuth direction about the central vertical axis defined by the antenna structure which is not perfectly aligned with earths central gravity axis.

7. The method of claim 1, wherein moving the direction of the radiation pattern of the antenna in a tilt direction towards the desired position comprises adjusting dipole feeding line(s) of the antenna.

8. An apparatus connectable to an antenna pivot axis of an antenna bracket, comprising at least one remote azimuth steering motor system for adjusting a position of an antenna or a direction of a radiation pattern of the antenna based on a desired azimuth value, wherein the antenna is connected to the antenna bracket and is mounted on an antenna structure;

a memory configurable to store azimuth, roll and tilt position values of the antenna or direction of the radiation pattern of the antenna relative to the antenna structure;

a processor in communication with the memory and the at least one motor system, wherein the processor is configured to:

receive desired azimuth and tilt position values for the antenna relating to a desired azimuth and tilt position of the antenna or direction of the radiation pattern of the antenna, determine a tilt offset for the antenna or direction of the radiation pattern of the antenna based on the current tilt position value and the required operation of remote azimuth steering apparatus to move the antenna or direction of the radiation pattern of the antenna, relative to the antenna structure to reach the desired azimuth position value;

control operation of the at least one remote azimuth steering motor system and a remote electrical tilt system to move the antenna or direction of the radiation pattern of the antenna relative to the antenna structure towards the desired azimuth and tilt positions based on the desired azimuth and tilt position values and the calculated tilt offset.

9. The apparatus of claim 8, wherein the apparatus is in communication with a further remote azimuth steering motor system, wherein the further remote azimuth steering motor system is configured to effect movement of the antenna bracket about a second pivot axis.

10. The apparatus of claim 8, wherein the apparatus is connected to dipole feeding line(s) of the antenna and the processor is configured to control dipole feeding line(s) to adjust tilt based on the tilt position value and the calculated tilt offset.

* * * * *